US007033148B2

(12) United States Patent
Bunner et al.

(10) Patent No.: US 7,033,148 B2
(45) Date of Patent: Apr. 25, 2006

(54) ELECTROMAGNETIC PUMP

(75) Inventors: Bernard Bunner, Watertown, MA (US); Manish Deshpande, Canton, MA (US); Sebastian Böhm, Inverness (GB); Richard Day, Wakefield, MA (US); John Richard Gilbert, Brookline, MA (US)

(73) Assignee: Cytonome, Inc., Watertown, MA (US)

( * ) Notice: Subject to any disclaimer, the term of this patent is extended or adjusted under 35 U.S.C. 154(b) by 194 days.

(21) Appl. No.: 10/329,013

(22) Filed: Dec. 23, 2002

(65) Prior Publication Data

US 2003/0180164 A1 Sep. 25, 2003

Related U.S. Application Data

(60) Provisional application No. 60/414,712, filed on Sep. 27, 2002, provisional application No. 60/365,002, filed on Mar. 13, 2002.

(51) Int. Cl.
*F04B 17/00* (2006.01)

(52) U.S. Cl. ..... 417/413.1; 417/521; 977/DIG. 1

(58) Field of Classification Search ..... 417/413.1, 417/321, 410.1, 472, 473, 521, 522, 536, 417/539, 246, 249, 254; 977/DIG. 1
See application file for complete search history.

(56) References Cited

U.S. PATENT DOCUMENTS 3,565,100 A * 2/1971 Pfleger ..... 137/269.5
4,152,098 A * 5/1979 Moody et al. ..... 417/413.1
4,379,681 A * 4/1983 Goudy, Jr. ..... 417/560
4,608,000 A * 8/1986 Tominaga ..... 417/413.1
4,874,299 A * 10/1989 Lopez et al. ..... 417/413.1
4,923,367 A * 5/1990 Zimmer ..... 415/199.1
5,241,986 A * 9/1993 Yie ..... 137/512
5,277,555 A * 1/1994 Robinson ..... 417/393
5,284,425 A * 2/1994 Holtermann et al. ..... 417/395
5,344,292 A * 9/1994 Rabenau et al. ..... 417/413.1
5,499,909 A * 3/1996 Yamada et al. ..... 417/384
5,529,465 A 6/1996 Zengerle et al.
5,759,014 A 6/1998 Van Lintel
6,033,191 A * 3/2000 Kamper et al. ..... 417/322
6,106,245 A * 8/2000 Cabuz ..... 417/322
6,261,066 B1 7/2001 Linnemann et al.

OTHER PUBLICATIONS

Capanu et al. "Design, fabrication, and testing of a bistable electromagnetically actuated microvalve." *J. Microelectromechanical Systems*. 2000;9(2):181-189.
Lisec et al. A bistable pneumatic microswitch for driving fluidic components. *Sensors and Actuators A* 1996;54:746-749.
Vandelli et al. "Development of a MEMS microvalve array for fluid flow control." *J. Microelectromechanical Systems*. 1998;7(4):395-403.

* cited by examiner

*Primary Examiner*—Charles G. Freay
(74) *Attorney, Agent, or Firm*—Lahive & Cockfield, LLP

(57) ABSTRACT

An electromagnetic micropump for pumping small volumes of liquids and gases comprises a magnetic actuator assembly, a flexible membrane and a housing defining a chamber and a plurality of valves. The magnetic actuator assembly comprises a coil and a permanent magnet for deflecting the membrane to effect pumping of the fluid. A plurality of micropumps may be stacked together to increase pumping capacity.

30 Claims, 11 Drawing Sheets

ELECTROMAGNETIC PUMP

RELATED APPLICATIONS

The present invention claims priority to U.S. Provisional Patent Application Ser. No. 60/414,712 filed Sep. 27, 2002, entitled "Electromagnetic Pump", and U.S. Provisional Patent Application Ser. No. 60/365,002 filed Mar. 13, 2002, entitled "Electromagnetic Pump", the contents of which are herein incorporated by reference.

FIELD OF THE INVENTION

The present invention relates to an electromagnetically actuated pump for pumping liquids and gases.

BACKGROUND OF THE INVENTION

Electromagnetic pumps are used in many applications to pump small volumes of liquids and gases. Conventional electromagnetic pumps have many disadvantages, including high power requirements, inadequate flow rates, complex and expensive manufacturing processes and bulky designs. Many conventional electromagnetic pumps require high drive voltages to attain adequate fluid delivery rates for many applications. Conventional electromagnetic pumps further require complex, expensive electronics to control the pumping process. Moreover, many electromagnetic pumps are not scalable for different applications.

SUMMARY OF THE INVENTION

The present invention provides an improved electromagnetic micropump for pumping small volumes of liquids and gases. The micropump comprises a magnetic actuator assembly, a flexible membrane and a housing defining a chamber and a plurality of valves. The magnetic actuator assembly comprises a coil and a permanent magnet for deflecting the membrane to effect pumping of the fluid. A plurality of micropumps may be stacked together to increase pumping capacity.

The electromagnetic micropump of the present invention is scalable, has low power requirements, a simplified manufacturing process, is small in size, lightweight and inexpensive to manufacture.

DETAILED DESCRIPTION OF THE INVENTION

The present invention provides an improved microscalable electromagnetically actuated pump for pumping microscale quantities of liquids and gases. The pump of the present invention is scalable and efficiently delivers liquids and gases while being relatively simple and inexpensive to manufacture. The present invention will be described below relative to an illustrative embodiment. Those skilled in the art will appreciate that the present invention may be implemented in a number of different applications and embodiments and is not specifically limited in its application to the particular embodiments depicted herein.

As used herein, "pump" refers to a device suitable for intaking and discharging fluids and can have different sizes, including microscale dimensions, herein referred to as "micropump."

As used herein, "valve" refers to communication region in a fluid chamber in a pump for regulating fluid flow into or out of the fluid chamber.

Figure 1:
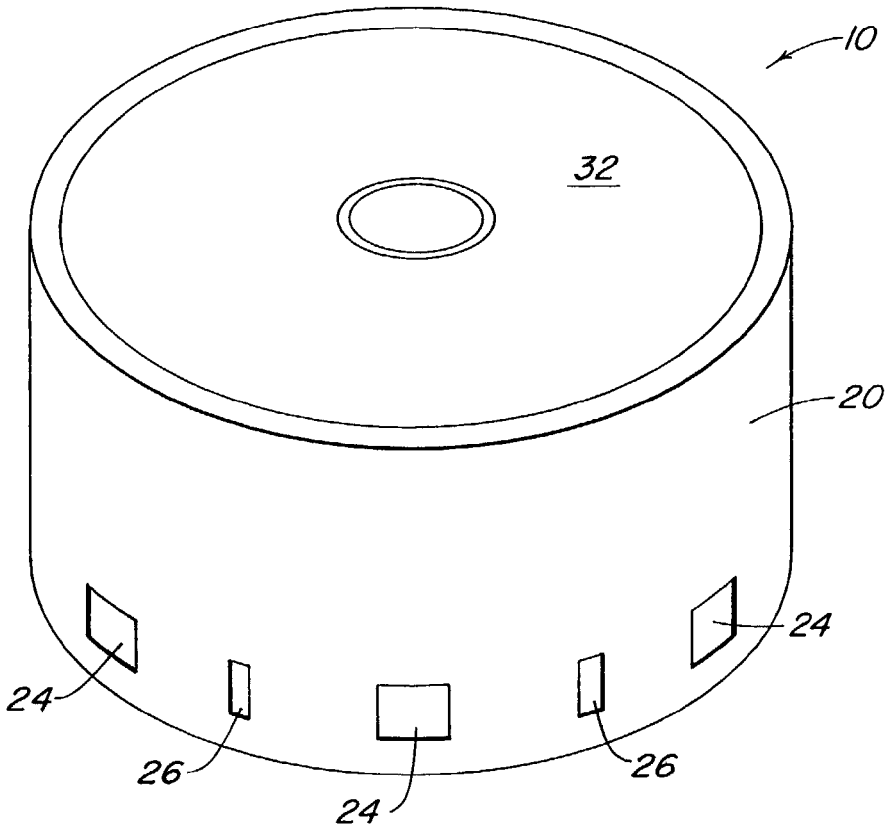
FIG. 1 is a schematic view of the electromagnetic pump of the present invention.
Figure 2:
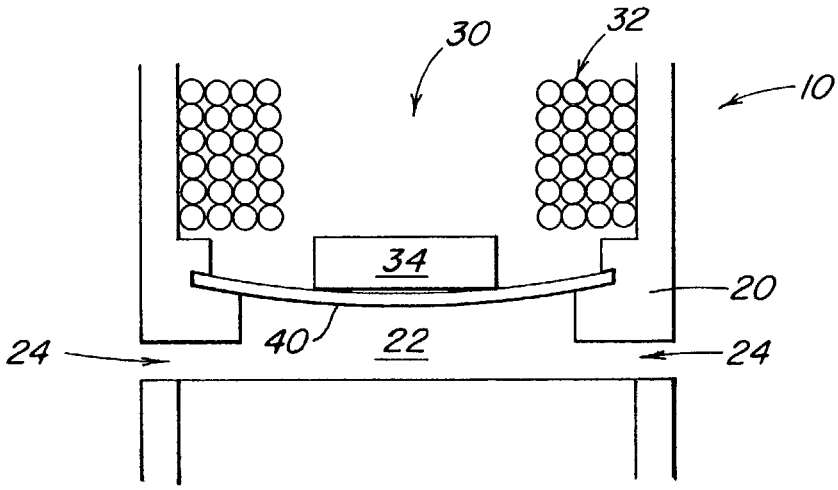
FIG. 2 is a cross-sectional view of the electromagnetic pump along lines A—A of FIG. 1.
Figure 3:
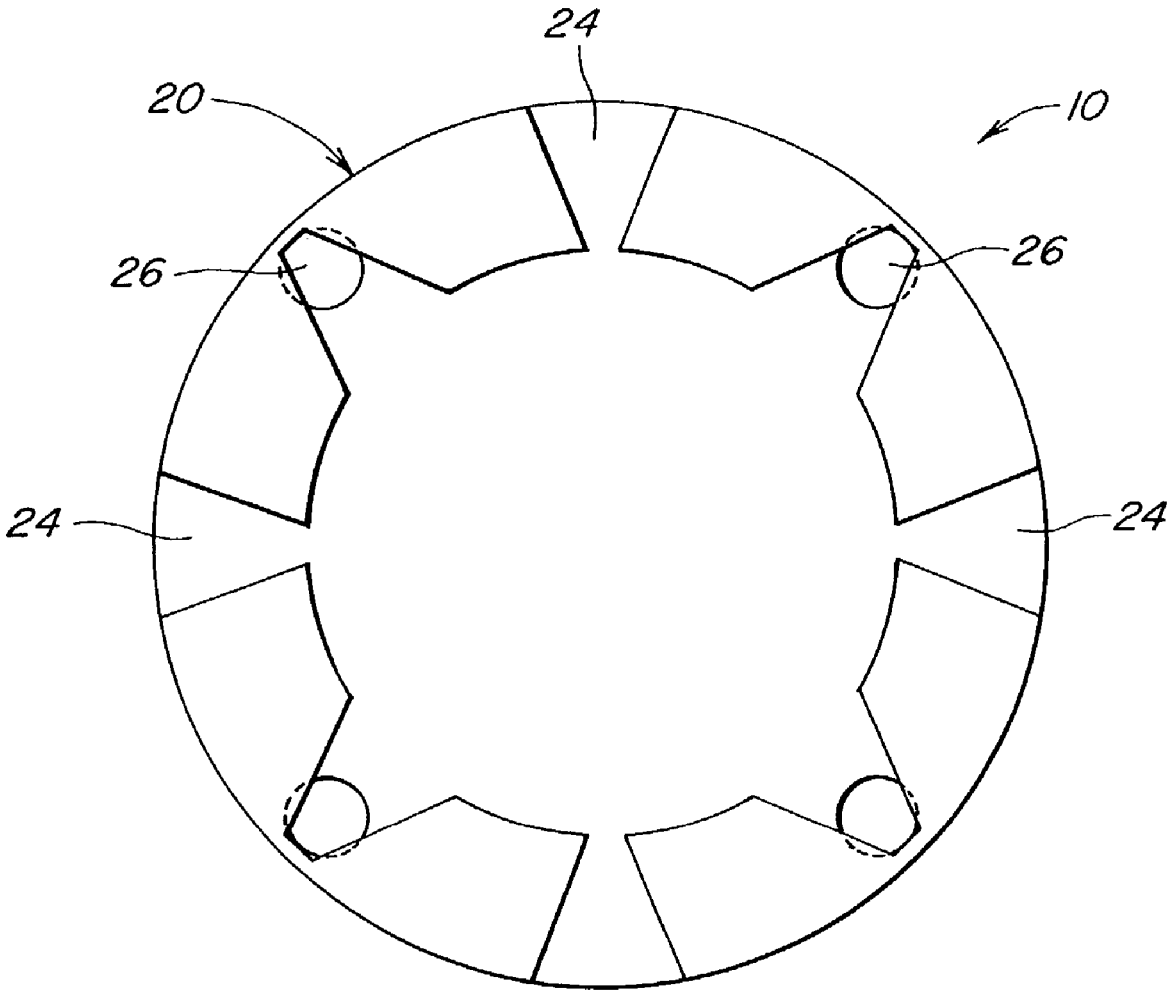
FIG. 3 is a top cross-sectional view of the electromagnetic pump along lines B—B of FIG. 1.

As shown in FIGS. 1–3, the electromagnetic micropump 10 of an illustrative embodiment of the present invention comprises a housing 20, an actuator assembly 30 and a membrane 40. The housing 20 and membrane 40 define a fluid chamber 22 for holding a fluid to be pumped. A plurality of inlet valves 24 and outlet valves 26 are disposed radially about the housing perimeter and communicate with the fluid chamber 22 to allow fluid to enter and exit the fluid chamber 22. The illustrative actuator assembly comprises a coil 32 and a magnet 34 connected to the membrane for controlling the position of the membrane 40. Alternatively, the actuator assembly may comprise a piezoelectric assembly, a thermoelectric assembly, shape-memory alloy or other suitable actuator known in the art. One skilled in the art will recognize that the actuator assembly can comprise any number or combination of parts. The membrane 40 oscillates between a first position and a second position to vary the volume of the chamber 22 when actuated by the actuator assembly 30.

According to an illustrative embodiment, the inlet valves 24 and outlet valves 26 are symmetrically disposed about the housing perimeter to provide efficient pumping. Alternatively, as shown in FIG. 3, the inlet valves 24 are spaced about the perimeter of the housing in the side wall, while the outlet valves are formed in the bottom surface of the housing 20. According to an illustrative embodiment, the housing 20 includes at least two inlet valves and two outlet valves, and preferably four, six or more of each. One skilled in the art will recognize that the valves may have any suitable number, arrangement and spacing.

The illustrative actuator assembly is activated by applying an electrical potential across the coil 32, which causes the magnet 34 to move, thereby deflecting the membrane 40. The deflection of the membrane causes the volume and therefore the pressure of the fluid chamber 22 to change. The change in pressure in the fluid chamber causes fluid to be drawn into the micropump chamber via the inlet valves 24 or discharged via the outlet valves 26. The coil is connected to electronics, which control the electrical potential applied to the coil. The electronics of the illustrative embodiment are relatively simple and inexpensive, comprising an RC circuit in combination with a pair of switches. According to the illustrative embodiment, the electronics energize the coil about 190 times per second to provide a flow rate of about 1.36 liters per hour. The electronics may include a controller and/or software for more sophisticated operation.

According to the illustrative embodiment, the housing 20 comprises a molded plastic material and is shaped as a cylinder, though one skilled in the art will recognize that the invention is not limited to the illustrative material and shape. The housing may be manufactured through injection molding.

The illustrative electromagnetic micropump 10 meets advantageous specifications, including low power requirements, sufficient flow rate, low cost, a compact size and a light weight, and scalability. The power consumption of the micropump 10 is about thirty milliwatts operating at 1.15 volts. The micropump 10 delivers liquids or gases at a flow rate of about 1.36 liters per hour (about 370 milliliters per second). The cost of manufacturing the micropump 10 is relatively low: about 10 cents each at volume. The micropump 10 can have a diameter that is about 13 mm and a thickness of about 5–6 mm to provide a volume of less than about 1 cc and preferably between about 0.6 and 0.8 cc or less. The micropump 10 can be easily scaled for different size, flow rates, voltage requirements by stacking multiple micropumps 10 together or varying the size of the components. The micropump can further be manufactured economically and efficiently.

Figure 4:
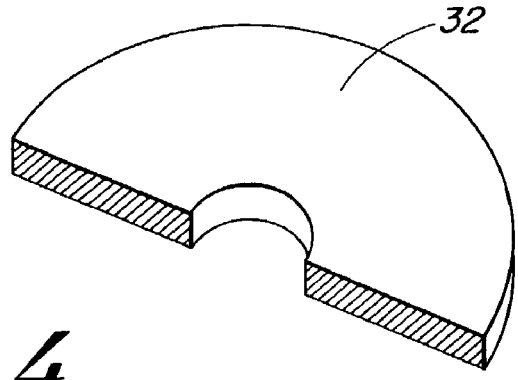
FIG. 4 is a detailed view of the coil of the electromagnetic pump of FIG. 1.

FIG. 4 illustrates the coil 32 of the micropump 10, which is disposed in a coil support formed in the housing 20. According to the illustrative embodiment, the coil 32 is a packed coil with a radius of 60 mm and 670 turns. The coil is formed of a conductive material, such as copper. The coil 32 further includes a 20 mm sheath to provide insulation. The illustrative coil 32 comprises 35 wire diameters in the horizontal direction for a diameter of about 4.9 mm and 19 wire diameters in the vertical direction for a thickness of about 2.7 mm. The coil 32 may be integrated into external packages.

A square wave actuation signal ([0; 1.15V], according to the illustrative embodiment) is generated by the connected electronics. The power dissipated in the illustrative coil 32 is about 30 mW (times 0.5, because the voltage is off half the time), resulting in a current of about 52 milliamps.

Figure 5:
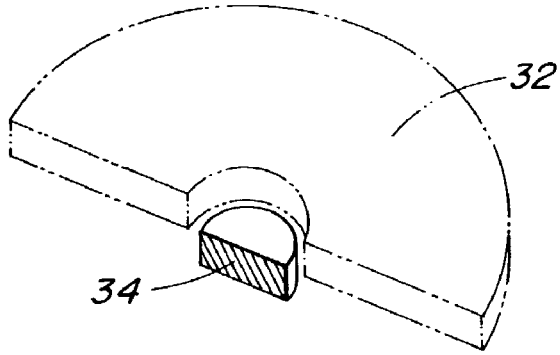
FIG. 5 is a detailed view of the magnet of the electromagnetic pump of FIG. 1.

FIG. 5 illustrates the permanent magnet 34 used in the micropump 10. According to the illustrative embodiment, the magnet 34 is formed of ferrite, though other materials may be used. The magnet 34 has a diameter of about 2 mm and a height of about 2 mm. The permanent magnetic flux density $B_r$ of the illustrative magnet 34 is about 0.3 and the magnetization, which may be constant, is about $B^r/m_0=2.4.10^5$ A/m. The force on the magnet 34, calculated from a semi-analytical model, is about 2.3 mN.

According to an alternate embodiment, the magnet 34 is formed of a soft ferromagnetic material, such as iron.

Figure 6:
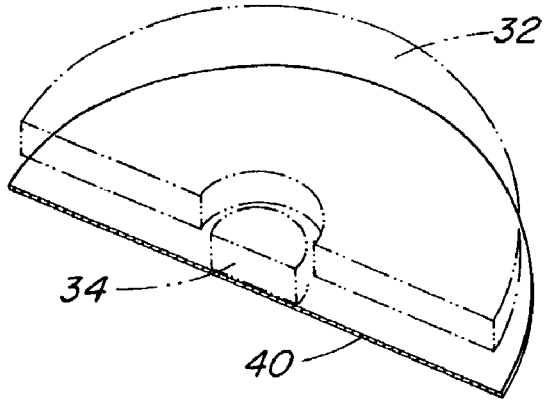
FIG. 6 is a detailed view of the membrane of the electromagnetic pump of FIG. 1.

FIG. 6 illustrates the membrane 40 of the micropump 10. The membrane comprises a flexible material, such as silicone, having E=10 Mpa. The membrane elastically deflects a controllable amount when the actuator assembly applies a force to the membrane. The illustrative membrane 40 has a radius of about 6.5 mm and a thickness of between about 100 and about 500 microns and preferably about 200 microns, though one skilled in the art will recognize that the invention is not limited to this range. The size of the membrane may be determined by the size and shape of the housing and desired pumping capacity.

According to the illustrative embodiment, the deflection of the membrane 40 due to point load at the membrane center may be calculated by an analytical expression as W=0.33 mm. To account for the fact that the magnet 34 is glued to the membrane and reduces the motion, the maximum deflection may be calculated as $w_{max}$=0.85 and the point deflection as $w_{point}$=0.29 mm.

Figure 7:
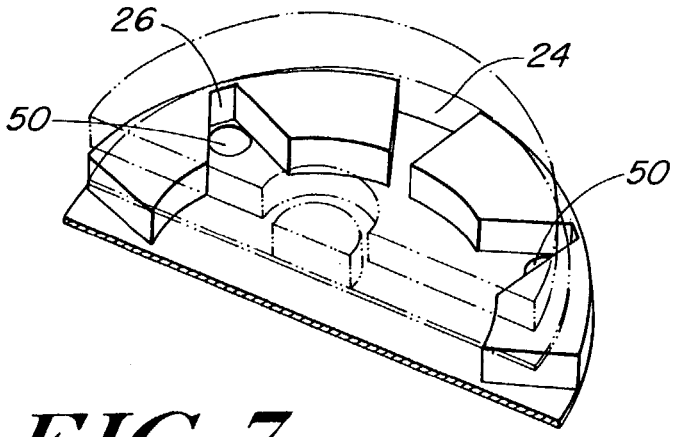
FIG. 7 is a detailed view of the fluid chamber and valves of the electromagnetic pump of FIG. 1.

FIG. 7 illustrates the fluid chamber 22, as well as the intake valves 24 and the outlet valves 26 communicating with the chamber 22. The volume of the fluid chamber 22 under the deflected membrane is calculated as: $V=pR_m^2w_{max}/2$, which, accounting for the fact that the deflection is only $w_{max}$ at the center of the membrane, is about nineteen milliliters.

The intake valves 24 and outlet valves 26 may be radially disposed about the perimeter of the housing. The valves may also be disposed in the top or bottom of the housing 20. According to the illustrative embodiment, the intake valves 24 and outlet valves 26 are diffuser valves and may be 4-way valves. The valves 10 may further include air intake ports 50. The air intake ports may be drilled radially or vertically in the cylindrical housing 20 to allow for air intake.

The manufacturing process for the micropump 10 of the illustrative embodiment is efficient, economical and simplified. The micropump chamber and valves may be constructed in plastic using injection molding or stamping, which is extremely inexpensive at high volumes. The support structure for the coil 32 may be stamped or injection molded in plastic. The coil 32, magnet 34 and membrane 30 may be bonded to the housing using any suitable bonding mechanism, if necessary, such as gluing, ultrasonic welding, thermal welding or any suitable means known in the art. The electronics for energizing the coil may be electrically connected to the coil using any means known in the art.

Figure 8:
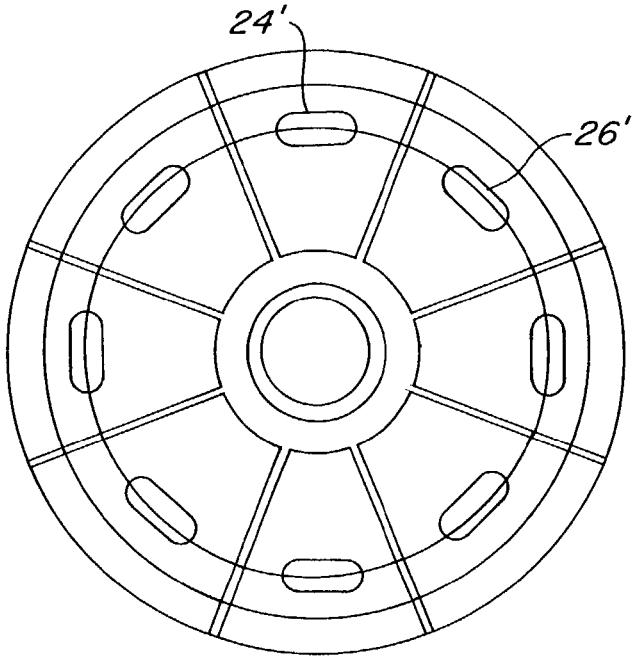
FIG. 8 illustrates an alternate embodiment of the present invention, including check valves.

According to one embodiment, shown in FIG. 8, the inlet and outlet valves may comprise check valves 24', 26', respectively, to increase the efficiency of the pumping.

Figure 9:
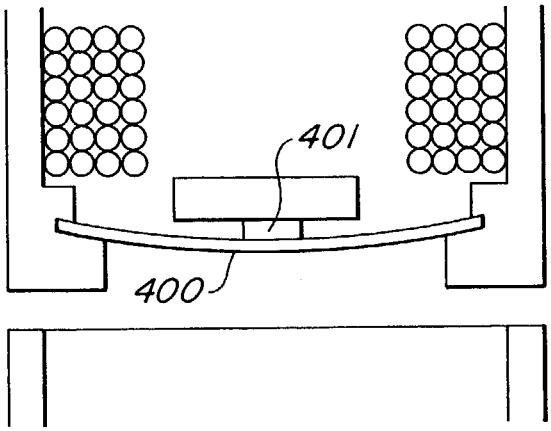
FIG. 9 illustrates an alternate embodiment of the present invention, including a bossed membrane.

According to another embodiment, shown in FIG. 9, a bossed membrane 400 may be used to concentrate the actuator force on the membrane center. The boss 401 allows for increased membrane deflection and flow rate.

Figure 10:
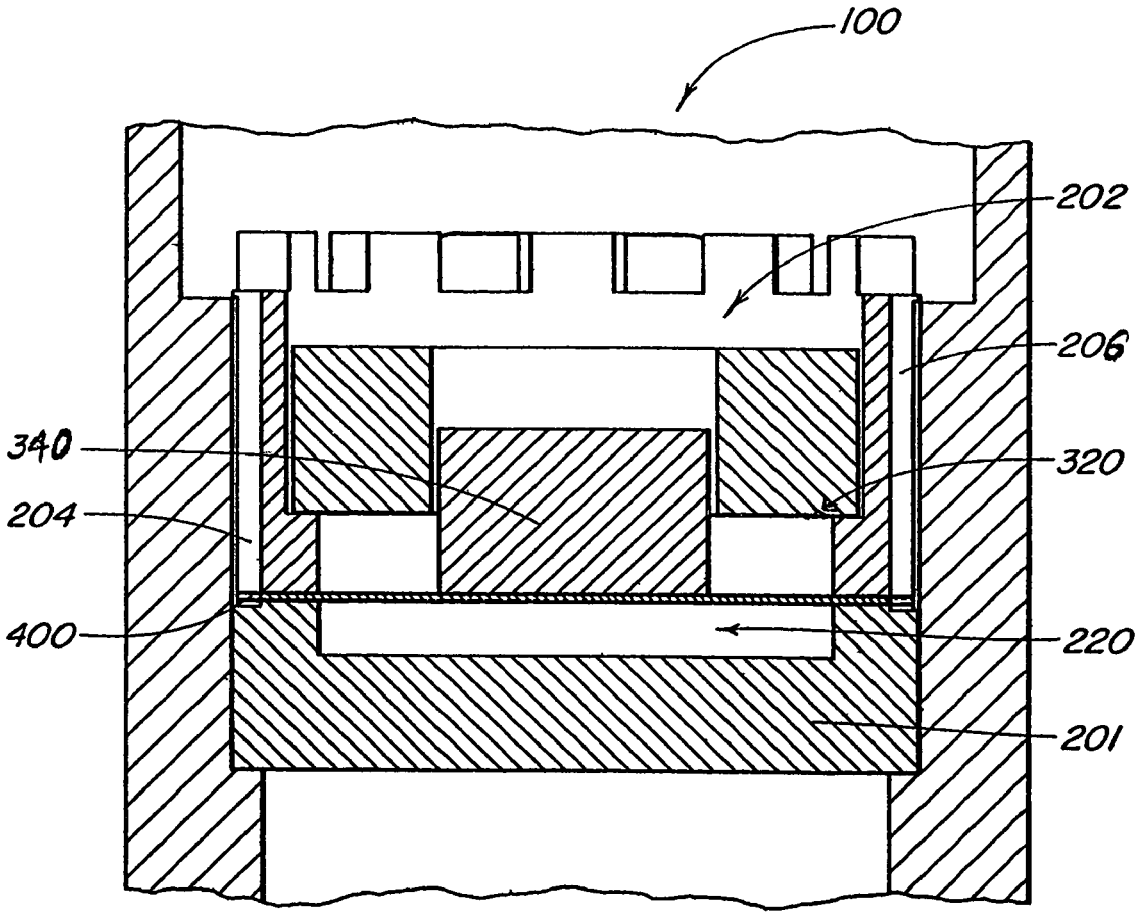
FIG. 10 illustrates an electromagnetic pump including a spacer element according to an alternate embodiment of the invention.
Figure 11:
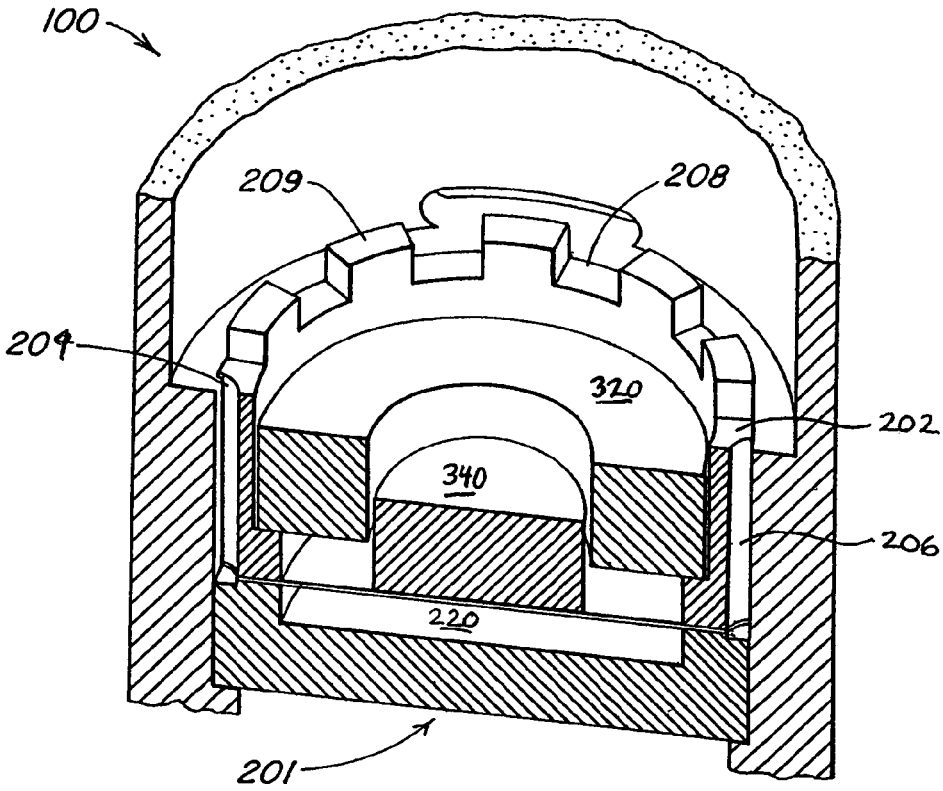
FIG. 11 is top view of the cross-section of the pump of FIG. 10.
Figure 12:
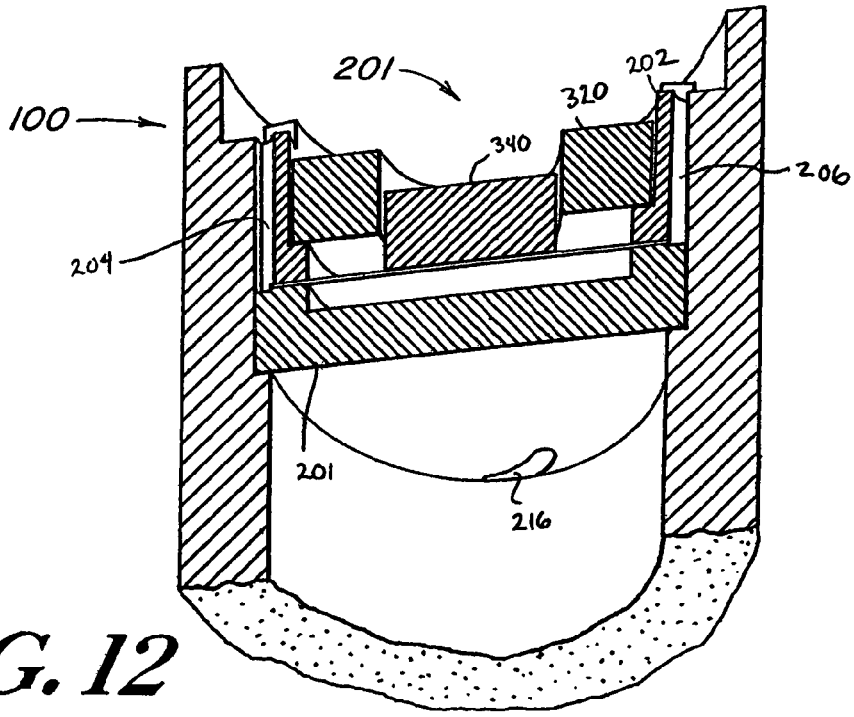
FIG. 12 is a bottom view of the cross-section of the pump of FIG. 10.

According to yet another embodiment of the invention, shown in FIGS. 10–12, an electromagnetic pump 100 includes a housing that comprises two separate components stacked together. As shown, in the embodiment of FIGS. 10–12, the inlets 204, 206 to the pump chamber 220 are formed above or to the side of the membrane 400, while the outlets 214, 216 from the pump chamber 220 are formed below the membrane 400. As shown, the inlets are formed by channels extending from the pump chamber through the sidewall of the housing of the pump 100. The placement of the inlet valves and the outlet valves on opposite sides of the membranes allows for a plurality of pumps to be stacked together. According to the illustrative embodiment, the pump 100 has a cylindrical shape, though one skilled in the art will recognize that any suitable shape may be used.

According to the embodiment illustrated in FIGS. 10–12, the housing of the pump 100 comprises a pump body 201, which includes in inlet valves 204, 206 and outlet valves 214, 216, respectively for communicating with a fluid chamber 220, and a spacer element 202 stacked on the pump body 201 for housing the actuator assembly. The membrane 400 is attached to the bottom of the spacer element between the pump body and the spacer element and defines the fluid chamber 220 for holding a fluid to be pumped. As shown, the illustrative actuator assembly is substantially identical to the actuator assembly of the pump 10 described in FIGS. 1–7 and includes a coil 320 and a magnet 340 connected to the membrane for controlling the position of the membrane 400. The coil 320 and magnet 340 are disposed in the internal cavity of the spacer element. The membrane 400 oscillates between a first position and a second position to vary the volume of the chamber 220 when actuated by the actuator assembly.

According to an alternate embodiment of the invention, the actuator assembly may comprise a piezoelectric assembly, a thermoelectric assembly, shape-memory alloy or any suitable actuator known in the art.

Figure 13:
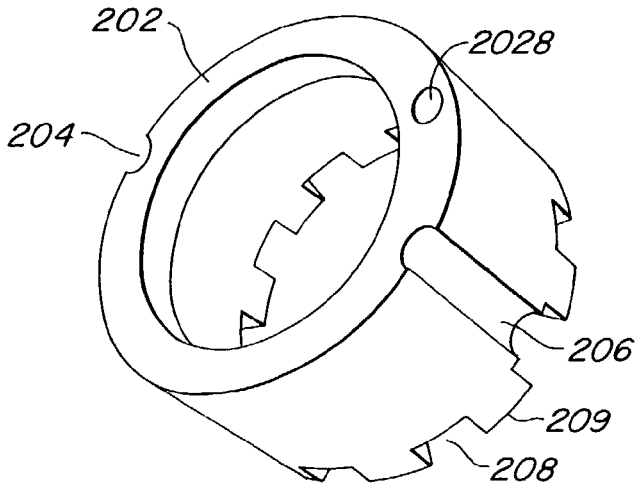
FIG. 13 illustrates the spacer element of the pump of FIG. 10.

FIG. 13 is a perspective view of an individual spacer element 202 of the electromagnetic pump 100 of FIGS. 10–12 according to an embodiment of the invention. The illustrated spacer element 202 is a cylindrical tube including a central hole for containing the actuator assembly. The spacer element includes inlet channels 204, 206 formed in the sidewall and extending through the length of the sidewall for communicating with the fluid chamber in the pump body 201. As shown in FIG. 11, the top surface of the spacer is a ridged surface, including alternating recesses 208 and protrusions 209 spaced around the perimeter of the top surface. The spacer element further includes an alignment recess 2028 for engaging an alignment protrusion 2018 (shown in FIG. 14) on the pump body 201 to assist in aligning the spacer element 202 with the pump body 201 when assembling the electromagnetic pump.

Figure 14:
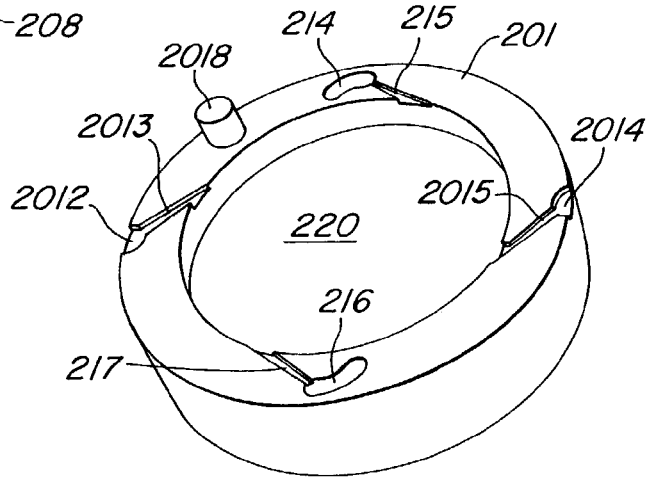
FIG. 14 illustrates the pump body of the pump of FIG. 10.

FIG. 14 illustrates an individual pump body 201 of the electromagnetic pump 100 according to an embodiment of the invention. The pump body 201 includes the alignment protrusion 2018 as well as receiving recesses 2012, 2014 configured to align with and communicate with the channels 204, 206, respectively, on the spacer element 202. The receiving recesses 2012, 2014 communicate with the fluid chamber 220 via channels 2013, 2015, respectively. The pump body 201 further includes outlet ports 214, 216 for connecting the fluid chamber 220 with the pump exterior. The outlet ports 214, 216 communicate with the fluid chamber 220 via channels 215, 217, respectively. The outlet ports may be disposed anywhere in the pump body for providing communication between the fluid chamber 220 and the exterior of the pump body. For example, an outlet port may extend directly from the pump chamber 220 to the bottom surface of the pump body.

Figure 15:
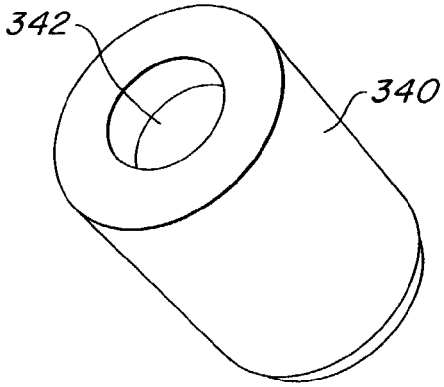
FIG. 15 is a top view of the magnet of the pump of FIG. 10.
Figure 16:
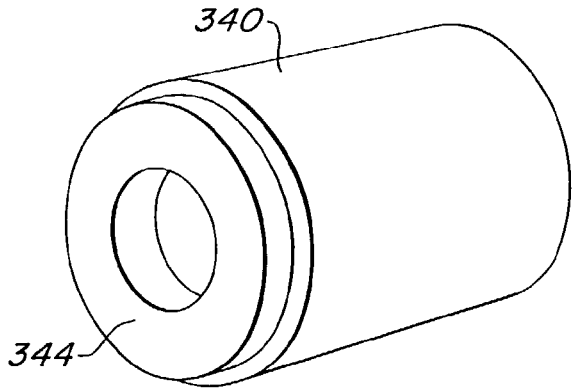
FIG. 16 is a bottom view of the magnet of the pump of FIG. 10.
Figure 17:
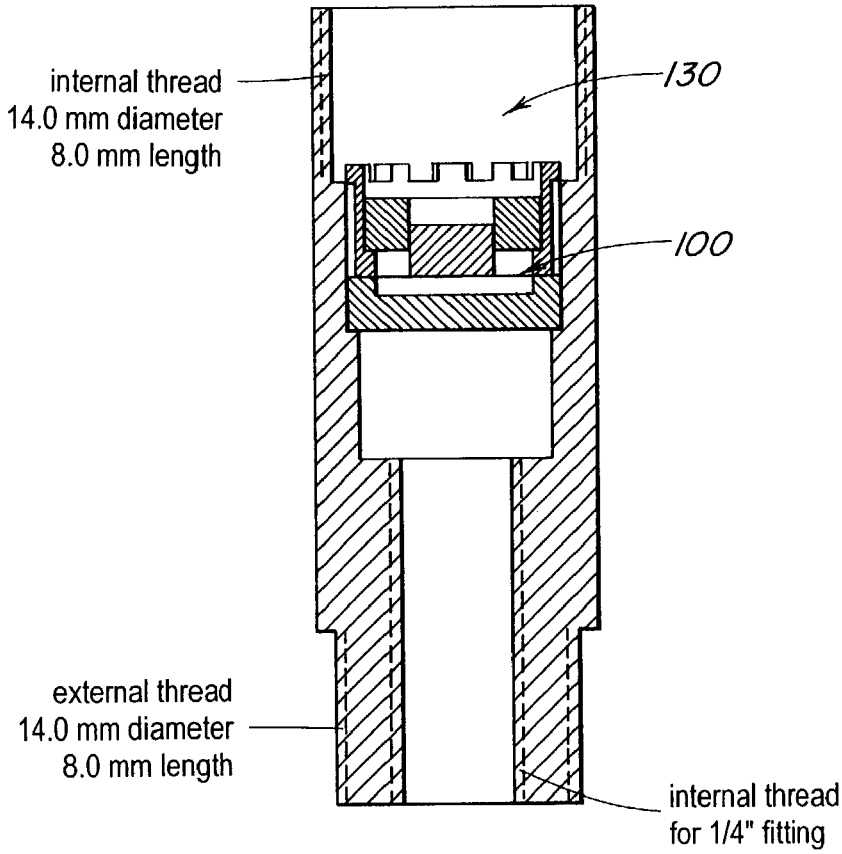
FIG. 17 illustrates the pump of FIG. 10 assembled in a cylindrical capsule.
Figure 18:
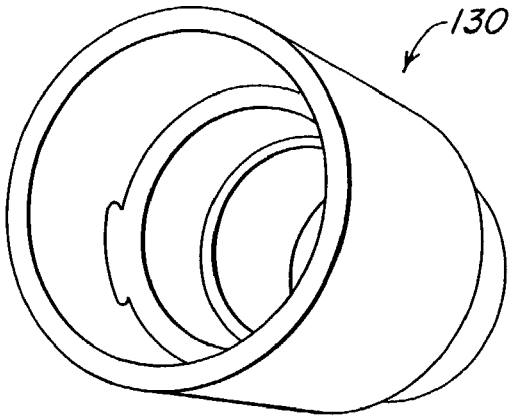
FIG. 18 illustrates the cylindrical capsule of FIG. 17.

FIGS. 15 and 16 illustrate an embodiment of the magnet 340 in the electromagnetic pump 100 of FIGS. 10–12. According to one embodiment, magnets may be used to hold the magnet 340 in place in the spacer element cavity. The top of the illustrative magnet 340 includes a recess 342 and the bottom of the illustrative magnet 340 includes an annular rim 344. One skilled in the art will recognize that the magnet is not limited to the illustrative embodiment and that alterations may be made The electromagnetic pump assembly shown in FIGS. 10–12 may be assembled and enclosed in a cylindrical capsule 130, as shown in FIG. 17. The capsule 130, shown in FIG. 18, may comprise a stepped tubular structure for holding the pump 100. A plurality of individual pumps may be connected or stacked in series within a capsule to generate a pressure head or a plurality of individual capsules may be connected in series to generate a pressure head. According to an illustrative embodiment the capsule 130 is threaded internally on one end with an externally matching thread on another end to facilitate leak proof connection between joined capsules and pumps within the stacked capsules. According to the embodiment shown in FIG. 17, the upper end of the capsule 130 has an internal thread that is about fourteen millimeters in diameter and about eight millimeters in length. The lower end of the capsule has an external thread that is fourteen millimeters in diameter and eight millimeters in length, such that a first capsule can be connected in series to a second capsule by inserting and screwing the lower end of the first capsule into the upper end of the second capsule. One skilled in the art will recognize that many different sizes can be used, depending on the particular application The electromagnetic pump 100 may be clamped or glued in the capsule 130. Other means of securing the pump in the capsule may also be used, such as press-fitting and the like.

Figure 19:
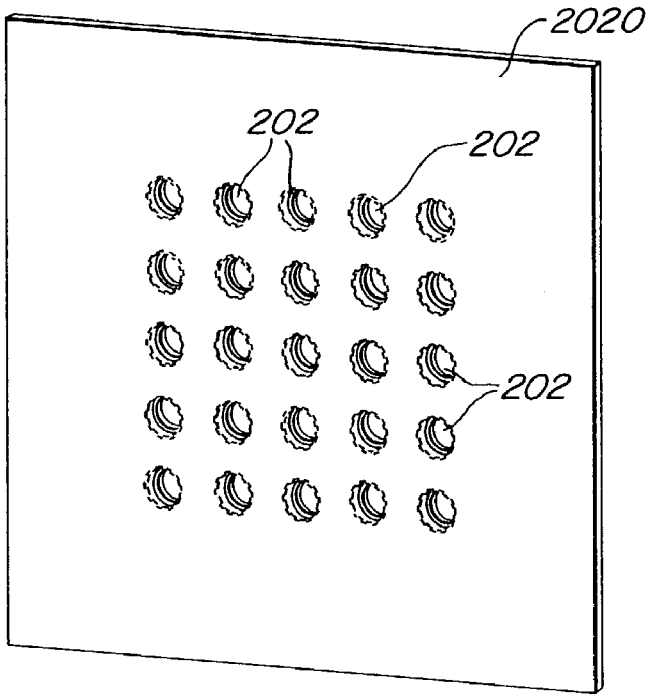
FIG. 19 is a top view of a spacer element plate containing an array of spacer elements for forming an array of electromagnetic pumps according to an embodiment of the invention.
Figure 20:
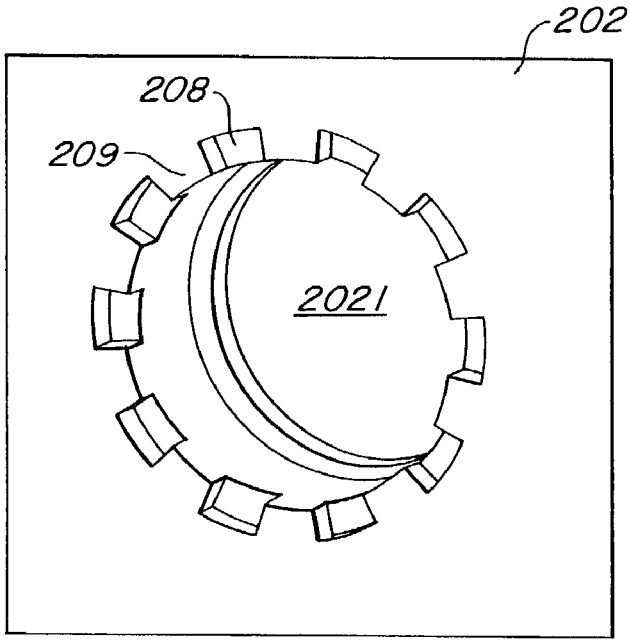
FIG. 20 is a detailed view of a spacer element in the array of FIG. 19.
Figure 21:
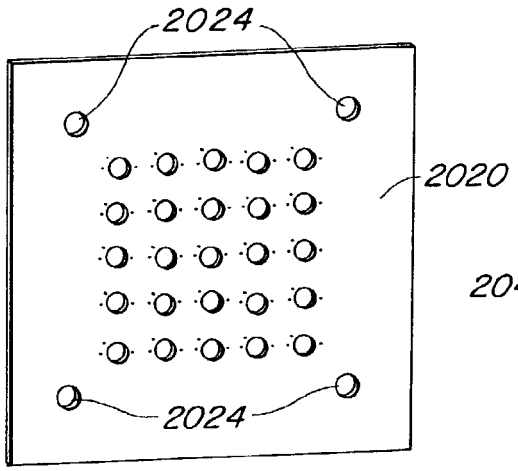
FIG. 21 is a bottom view of the spacer element plate of FIG. 19.
Figure 22:
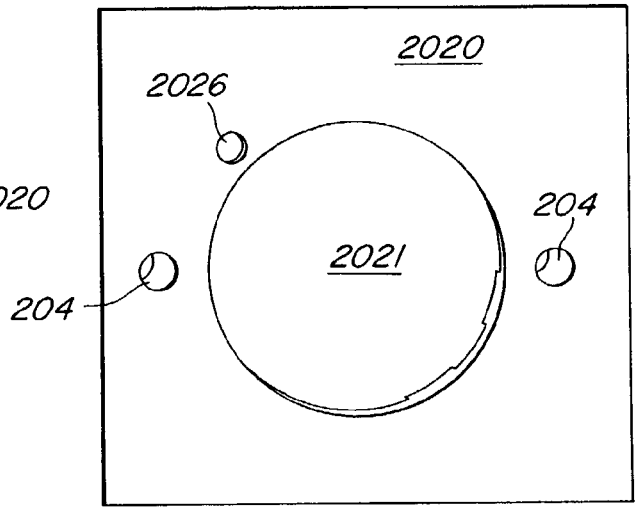
FIG. 22 is a detailed view of a spacer element of FIG. 21.

According to another embodiment of the invention, an array of electromagnetic pumps may be formed and operated simultaneously to increase throughput. For example, as shown in FIGS. 19–22, a plurality of spacer elements 202 may be formed in a spacer plate 2020. Each spacer element is defined by a central through-hole 2021, which defines the central cavity of the spacer element for receiving the actuator assembly. FIGS. 19 and 20 illustrate a first side of the spacer plate, which includes a plurality of recesses formed in the first surface around the perimeter of the central through-hole 2021 to form the ridged upper surface. FIGS. 21–22 show the second side of the spacer plate 2020, to which the membrane 400 is attached. The membrane 400 may be glued to the spacer array 2020. One skilled in the art will recognize that any suitable attachment means may be used. As shown, the spacer plate 2020 may include a plurality of alignment through-holes 2024, which are formed in the outer corners of the plate in the illustrative embodiment. Each spacer element 202 further includes a plurality of port through-holes 204, 206 for communicating with the pump chamber when the array of electromagnetic pumps is assembled. Each spacer element further includes a spacer alignment recess 2026 for aligning the spacer elements with corresponding pump bodies in a pump body plate 2010, shown in FIGS. 23 and 24.

Figure 23:
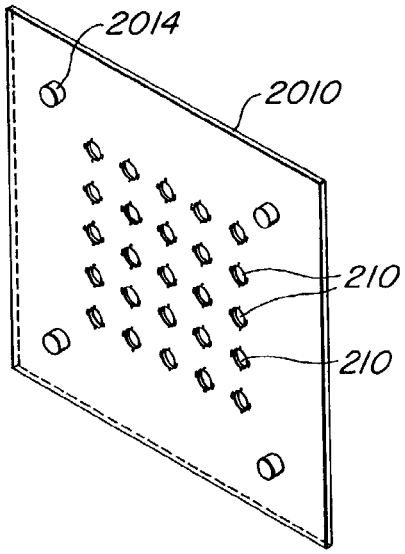
FIG. 23 illustrates a pump body plate containing an array of pump body elements formed therein for forming an array of electromagnetic pumps according to an embodiment of the invention.
Figure 24:
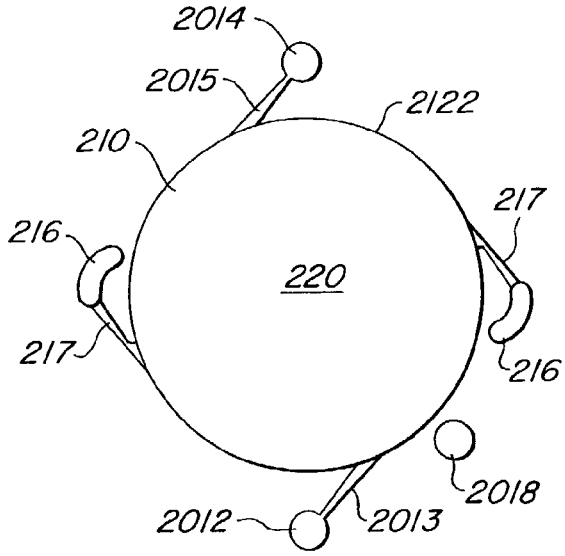
FIG. 24 is a detailed view of a pump body of FIG. 23.

FIGS. 23 and 24 illustrate a pump body plate 2010 including an array of pump body elements 210 corresponding to the spacer elements 202 of the spacer element plate 2020. As shown, the pump body plate 2010 includes a plurality of alignment posts 2014, which engage the alignment through-holes 2024 of the spacer element plate 2020 when the two plates are stacked together. Each individual pump body element 210 includes a recess 2122 defining the fluid chamber 220 and receiving recesses 2012 and 2014, defining inlet ports, connected to channels 2013, 2015, respectively for connecting the channels 204, 206 of the spacer element 210 to the fluid chamber 220. The pump body also includes outlet ports 214 and 216 spaced about the circumference of the fluid chamber 220 from the receiving recesses, which are connected to channels 215, 217 for connecting the fluid chamber 220 to the exterior of the pump. Each individual pump body element in the array further includes an alignment post 2018 for aligning the pump body with an associated spacer element in an array of electromagnetic pumps.

Figure 25:
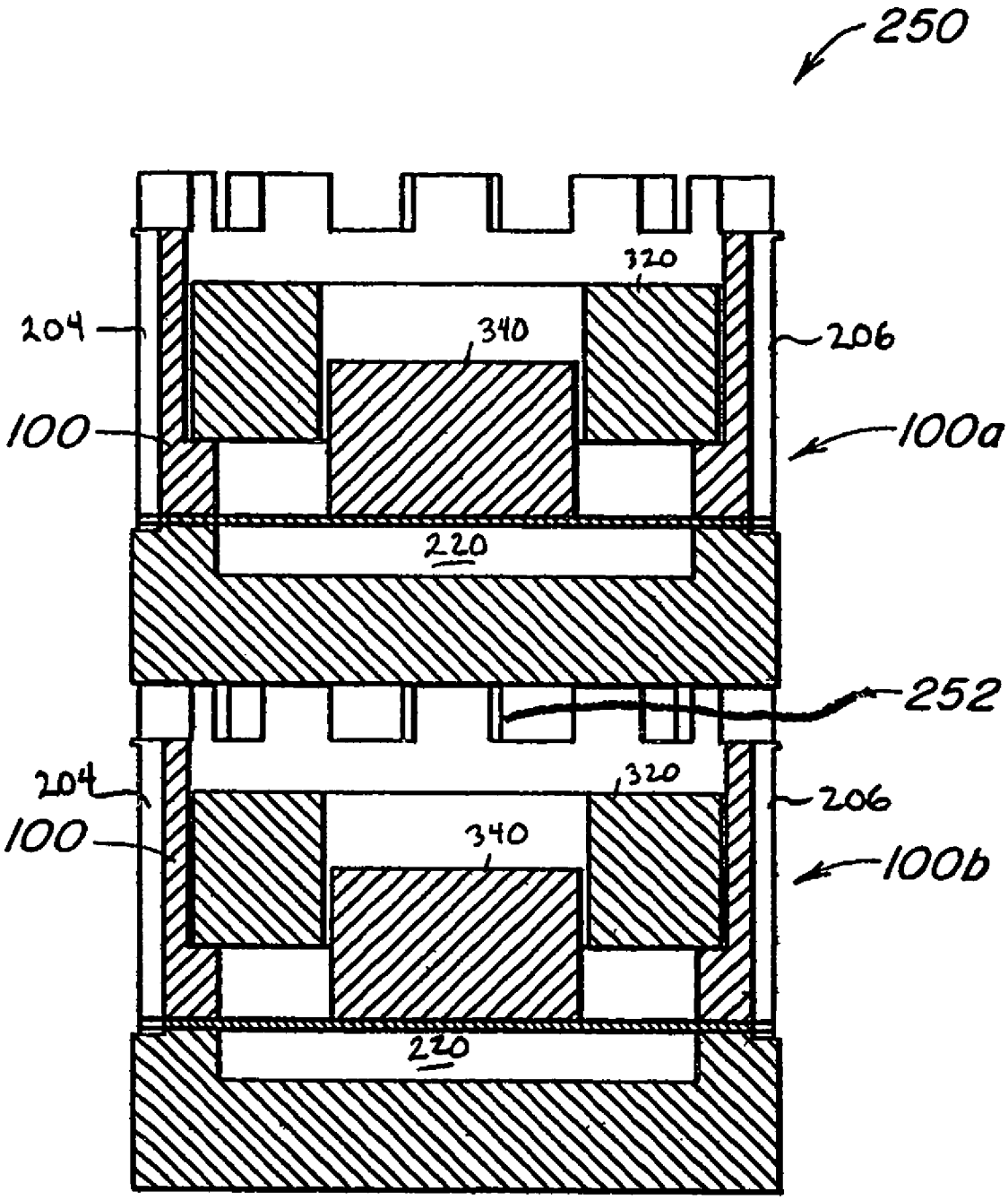
FIG. 25 illustrates an array of electromagnetic pumps stacked together to increase pumping capacity.

FIG. 25 illustrates an array 250 of electromagnetic pumps 100 stacked together to increase pumping capacity. As shown, the stacked pumps 100*a*, 100*b* form a sealed chamber 252 therebetween including the atmosphere above the membrane in the first pump 100*a*. The fluid chamber is in communication with the outlet of the second pump and the inlet of the first pump. Fluid pumped from the second pump 100*b* exits the second pump outlets and enters the first pump 100*a* through the first pump inlets. One skilled in the art will recognize that any suitable number of pumps may be stacked together in the array 150 in accordance with the teachings of the invention.

The placement of the input ports and the output ports on opposite sides of the fluid chamber 220 allows transfer of fluid from one pump to the next in series. The distribution of the input and output ports around periphery of the pump body make pump operation invariant to orientation in the plane of the pump.

The electromagnetic pump of the invention is a low power, low voltage electromagnetically actuated pump that is scalable by design. A plurality of pumps may be stacked in series to generate pressure head, or in parallel to generate flow rate.

The micropump 10 is scalable over different parameters, such as size and multiplicity, to maximize flow rate or pressure. For example, a desired flow rate can be obtained by varying the sized of the components, such as the micropump radius. The magnet height and thickness and the coil properties, such as material, coil density and packing, can also be varied as necessary. Size constraints due to packaging issues can also be met by varying the size of the components.

Multiple micropumps may be stacked together in series or in parallel to optimize a selected parameter. The micropumps may be stacked in series by aligning the outlet of a first micropump with the inlet of a second micropump to increase pressure head. Alternatively, a plurality of micropumps may be stacked in parallel by aligning the outlet of a first micropump with the outlet of a second micropump, in order to increase the flow rate of the fluid being pumped.

The electromagnetic pump of the present invention presents significant advantages over prior electromagnetic pumps for delivering small volumes of liquids and gases. The micropump is easily scaleable by stacking a plurality of micropumps together or by varying the diameter of the components. The electromagnetic pump has a relatively simple construction that is inexpensive to manufacture (i.e. down to and less than 10 cents per pump at high volume). The micropump operates at a low power and low voltage (i.e. 10–50 mW power consumption @ 1–5 Volts). The micropump is relatively small and lightweight (i.e. 25–1 cc volume made of light materials) and is suitable for a range of flow rates, between about 100 and about 400 mL per second and a variety of pressures.

The electromagnetic pump is not limited to the illustrative embodiment and alterations may be made. For example, the valve design may be altered to optimize performance by varying the angle of the valve, include diffusers or add Tesla-type (complex, most efficient) designs. Alternatively, the membrane thickness, material and size may be altered and the actuator position, configuration, size or materials may be varied to optimize performance.

The present invention has been described relative to an illustrative embodiment. Since certain changes may be made in the above constructions without departing from the scope of the invention, it is intended that all matter contained in the above description or shown in the accompanying drawings be interpreted as illustrative and not in a limiting sense.

It is also to be understood that the following claims are to cover all generic and specific features of the invention described herein, and all statements of the scope of the invention which, as a matter of language, might be said to fall therebetween.

The invention claimed is:

1. An electromagnetically actuated pump, comprising:

a housing including a side wall and a bottom wall defining a fluid chamber;

a flexible membrane defining a top wall of the fluid chamber for varying the size of the fluid chamber; and an actuator assembly for moving the membrane comprising a coil and a permanent magnet connected to the membrane;

a plurality of inlets to the fluid chamber radially distributed about a perimeter of the side wall of the housing; and at least one outlet from the fluid chamber formed in the bottom wall of the housing.

2. The pump of claim 1, wherein the housing comprises a spacer element containing the actuator assembly and a pump body defining the fluid chamber.

3. The electromagnetically actuated pump of claim 1, further comprising a capsule for containing the pump.

4. The electromagnetically actuated pump of claim 3, wherein a plurality of capsules are stacked in series.

5. The electromagnetically actuated pump of claim 1, wherein the fluid chamber has a volume of less than about one cubic centimeter.

6. The electromagnetically actuated pump of claim 1, wherein the fluid chamber has a volume of between about 0.6 cubic centimeters and about 0.8 cubic centimeters.

7. The electromagnetically actuated pump of claim 1, wherein one of said inlet and said outlet comprises a check valve.

8. The electromagnetically actuated pump of claim 1, wherein the housing has a diameter of between about 10 and about 15 millimeters.

9. An electromagnetically actuated pump comprising:

a first plate having a first side and a second side;

a plurality of spacer elements formed in the first plate, wherein each spacer element comprises an aperture containing an actuator assembly comprising a coil and a permanent magnet, and a ridged upper surface around a perimeter of the aperture on a first side of the plate;

a second plate having a first side and a second side stacked with the first plate;

a plurality of pump bodies formed in the second plate, wherein at least one of said plurality of pump bodies includes a central recess defining a pump chamber disposed opposite the aperture of the spacer element and includes at least one input port and outlet port for the pump chamber; and a membrane disposed between the first plate and the second plate and coupled to the second side of the first plate.

10. An electromagnetically actuated pump, comprising:

a housing comprising a spacer element coupled to a base to define a fluid chamber;

a flexible membrane held between the spacer element and the base to form a top wall of the fluid chamber;

an actuator assembly coupled to the membrane;

an inlet to the fluid chamber formed in the spacer element on a first side of the membrane; and an outlet from the fluid chamber formed in the base on a second side of the membrane in a bottom wall formed by the base of the fluid chamber opposite the first wall.

11. The pump of claim 10, wherein the fluid chamber has a volume of less than one cubic centimeter.

12. The pump of claim 10, wherein the housing comprises a first component having a recess formed therein defining the fluid chamber and a second component including the actuator assembly stacked on the first component.

13. The pump of claim 12, wherein one of said first component and said second component includes an alignment protrusion and the other of said first component and said second component comprises an alignment recess configured to receive the alignment protrusion.

14. The pump of claim 12, wherein the inlet is formed in said second component and the outlet is formed in said first component.

15. The pump of claim 14, wherein the second component comprises a cylindrical body having defined by a side wall and a hollow interior.

16. The pump of claim 15, wherein the inlet comprises a channel formed in the side wall of the second component.

17. The pump of claim 16, wherein the inlet extends through the length of the second component from a first end of the second component to a second end of the second component.

18. The pump of claim 15, wherein the inlet comprises a channel extending through the side wall of the second component.

19. An electromagnetic pump, comprising a cylindrical housing having a peripheral surface and defining a fluid chamber;

a flexible membrane defining a wall of the fluid chamber for varying the size of the fluid chamber;

an actuator assembly for moving the membrane comprising a coil and a permanent magnet coupled to the membrane, and a plurality of inlet valves formed around the peripheral surface of the housing and in communication with the fluid chamber, and an outlet to the fluid chamber formed in a bottom surface of the fluid chamber.

20. The pump of claim 19, wherein said plurality of valves are arranged symmetrically around the peripheral surface of the housing.

21. The pump of claim 19, wherein said plurality of valves comprises two inlet valves and two outlet valves.

22. The pump of claim 19, wherein said plurality of valves comprises four inlet valves and four outlet valves.

23. The pump of claim 19, wherein said plurality of valves comprises six inlet valves and six outlet valves.

24. The pump of claim 19, wherein said plurality of valves comprises at least one diffuser valve.

25. The pump of claim 19, wherein said plurality of valves comprises at least one check valve.

26. A stacked array of pumps, comprising:

a first pump comprising a housing including a spacer element coupled to a base to define a fluid chamber, a flexible membrane, an actuator assembly for moving the membrane to change the volume of the fluid chamber, an inlet to the fluid chamber formed on a first side of the membrane in the spacer element and an outlet to the fluid chamber formed on a second side of the membrane in the base;

a second pump stacked on top of the first pump comprising a housing including a spacer element coupled to a base to define a fluid chamber, a flexible membrane, an actuator assembly for moving the membrane to change the volume of the fluid chamber, an inlet to the fluid chamber formed on a first side of the membrane in the spacer element and an outlet to the fluid chamber formed on a second side of the membrane in the base, wherein a sealed chamber is formed by the stacked first and second pumps, such that the spacer element of the first pump contacts the base of the second pump and including atmosphere above the membrane of the first pump, wherein the sealed chamber is in fluid communication with the inlet of the first pump and the outlet of the second pump.

27. A micropump, comprising:

a housing comprising a spacer element and a pump body coupled to the spacer element to define a microfluid chamber;

a membrane coupled to the housing at intersection of the pump body and the spacer element and forming a wall of the microfluid chamber;

an actuator assembly contained in the spacer element for selectively moving the membrane;

an inlet extending through a side wall of the spacer element, substantially parallel to the side wall, through the pump body and into the fluid chamber; and an outlet from the fluid chamber formed in the pump body.

28. The micropump of claim 27, wherein the microfluid chamber has a volume of less than about one cubic centimeter.

29. The micropump of claim 27, further comprising an inlet to the fluid chamber and an outlet to the fluid chamber.

30. The micropump of claim 29, further comprising a valve coupled to one of the inlet and outlet.

* * * * *